US005174710A

United States Patent [19]

Dragos

[11] Patent Number: 5,174,710

[45] Date of Patent: Dec. 29, 1992

[54] MERCHANDISE PROTECTOR

[76] Inventor: George Dragos, 625 W. 100 N., Valparaiso, Ind. 46383

[21] Appl. No.: 676,088

[22] Filed: Mar. 27, 1991

[51] Int. Cl.[5] ..... B66F 9/18

[52] U.S. Cl. ..... 414/607; 414/785; 414/910; 414/911

[58] Field of Search ..... 414/607, 684, 745.1, 414/746.5, 785, 908, 910, 911, 913; 293/132, 135, 137

[56] References Cited

U.S. PATENT DOCUMENTS

| | | | |
|---|---|---|---|
| 1,418,034 | 5/1922 | Tennent . | |
| 1,586,339 | 5/1926 | Suporter . | |
| 2,887,092 | 5/1959 | Brady | 414/607 X |
| 3,037,187 | 5/1962 | Blakistone . | |
| 3,042,241 | 7/1962 | Bauman | 414/607 X |
| 3,284,100 | 11/1966 | Goff | 293/137 X |
| 3,363,318 | 6/1968 | Folkins et al. . | |
| 3,730,368 | 5/1973 | Dalglish . | |
| 3,741,346 | 6/1973 | Herdemann | 414/785 X |
| 4,005,793 | 2/1977 | Smith . | |
| 4,102,464 | 7/1978 | Schuster | 414/607 X |
| 4,154,470 | 5/1979 | Dalglish | 414/911 X |
| 4,279,567 | 7/1981 | Thompson | 414/785 |
| 4,310,281 | 1/1982 | Egashira | 414/746.5 X |
| 4,358,143 | 11/1982 | Cullen | 414/684 X |
| 4,515,522 | 5/1985 | Sonerud | 414/910 |
| 4,687,244 | 8/1987 | Cullen et al. | 414/684 |
| 4,893,857 | 1/1990 | Bobinger et al. | 293/132 X |

OTHER PUBLICATIONS

Photos of Commercial Ram/Tractor.
Drawing of Commercial Ram/Tractor.

*Primary Examiner*—Michael S. Huppert
*Assistant Examiner*—James Keenan
*Attorney, Agent, or Firm*—Wood, Phillips, VanSanten, Hoffman & Ertel

[57] ABSTRACT

Merchandise protector apparatus in conjunction with a lift truck of the type having a horizontal ram is used to enter the core of a coil of steel or like material and move the coil. The apparatus includes a contact wall mounted generally vertically at a right angle to the ram near but in front of its base, such that the edge of the coil, which coil is not aligned with the ram, will first contact a surface pad on the contact wall. The contact wall is mounted with shock absorbers such as springs for absorbing energy of contact and telescoping mechanisms for allowing the contact wall to move rearward and a roller on the top surface of the ram which transfers vertical loading to the ram. The apparatus serves to prevent dents in the coil edges and turn the coil to align it with the ram.

13 Claims, 2 Drawing Sheets

MERCHANDISE PROTECTOR

FIELD OF THE INVENTION

This invention relates generally to lift trucks which are employed to lift any type of coiled merchandise, such as steel, aluminum or paper coils, using a generally horizontal ram unit to enter an opening in the center of the coil and lift the coil by means of the ram.

BACKGROUND OF THE INVENTION

In steel rolling mills and other places where large heavy rolls are handled, the rolls are most often moved using large heavy-duty lift trucks equipped with a generally horizontal "ram" unit. One example of such a ram unit for a lift truck is shown in U.S. Pat. No. 4,005,793, entitled *Ram For Lift Truck* and issued in the name of Robert L. Smith. Commercial lift trucks employing rams have been made by Elwell-Parker, Yale, Autolift and Clark Equipment Corp.

Unfortunately, in practice, such ram lift trucks often are used or misused so as to dent or damage the rolls when they are loaded onto the ram. This is often the result of the operator driving the ram in at angle and at too high of a speed so as to cause the side edge of the coil to be hit and dented by the front of the lift truck. Such dents often go undetected until well after the damage has been done, making it difficult to effectively manage truck operation and prevent the problem. The dented steel roll often has to be rerolled to remove the dent or have the portion of the roll bearing the dent cut off and scrapped—a costly solution, in either case.

SUMMARY OF THE INVENTION

To help prevent such damage in the first place, the present invention provides load cushioning apparatus for such coil lifting trucks.

A lift truck employing the present invention would include a movable contact wall means mounted generally vertically at an approximate right angle to the truck's ram. The contact wall means extends horizontally on both sides of the ram for a distance at least approximating the radius of the coil so that the side edges of a coil will contact the wall means when the coil is entered by the ram when off-line with the core opening of the coil. Further provided are mounting means for the contact wall means, which mounting means includes shock absorbing means for absorbing horizontal forces and for allowing the contact wall means to move backward relative to the ram in response to the contact with a coil.

The invention, together with further advantages and features thereof, may best be understood by reference to the following description taken in connection with the accompanying drawings, in the several figures of which like reference numerals identify like elements.

DETAILED DESCRIPTION OF ONE PREFERRED EMBODIMENT

Figure 1:
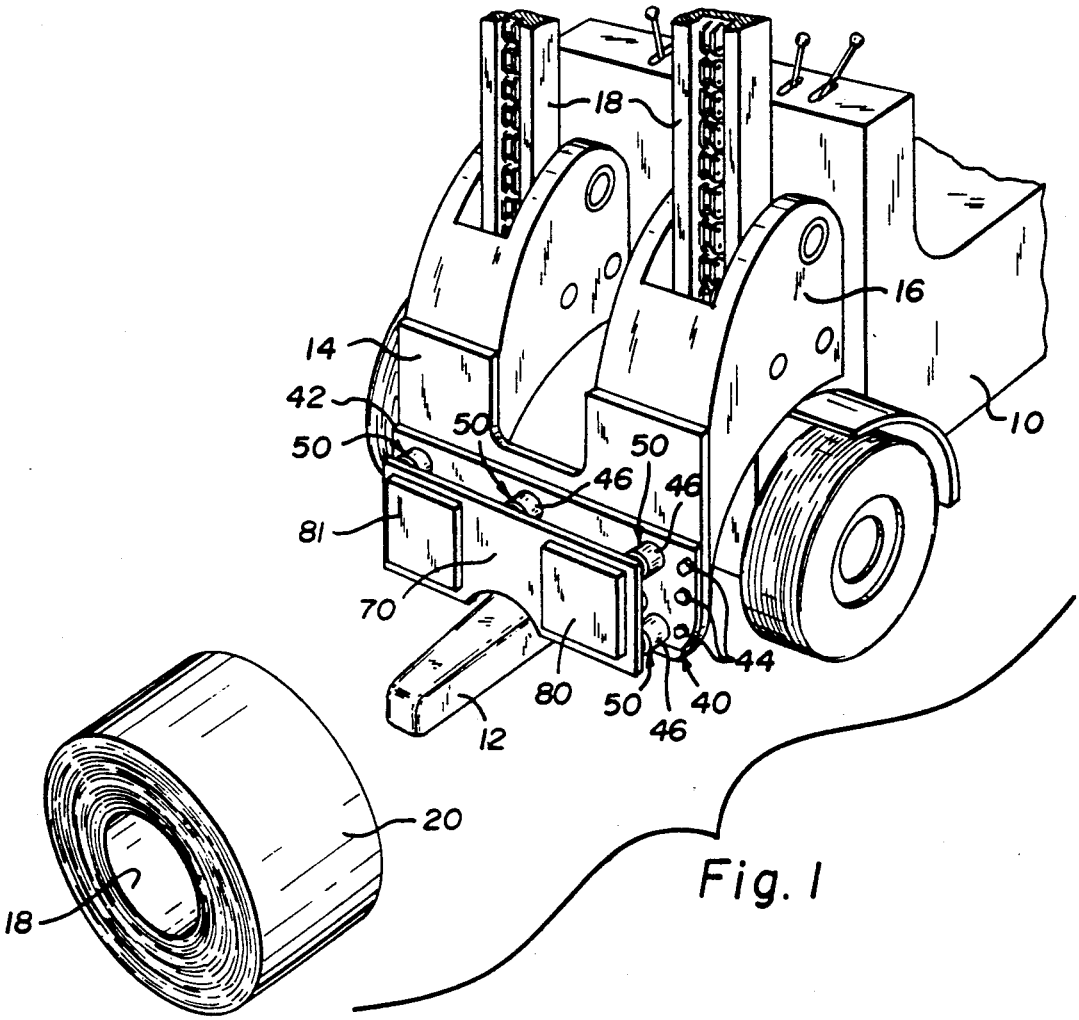
FIG. 1 is a perspective view of steel coil and a lift truck including as an improvement merchandise protector apparatus constructed in accordance with the principles of the present invention.

Referring to the figures and especially FIG. 1, there is depicted a heavy-duty lift truck 10 equipped with a generally horizontal ram 12 sized to fit into the central opening 18 of a coil 20 of rolled sheet steel or the like. For definiteness of disclosure of this example, the truck 10 is of the Elwell-Parker type, Model FKSE 20, which trucks come in different capacities so as to be able to lift 20,000 pound loads or 30,000 pound loads. Although herein described in conjunction with this one type of truck, the invention may be easily adapted to be used with other types of such trucks.

Figure 3:
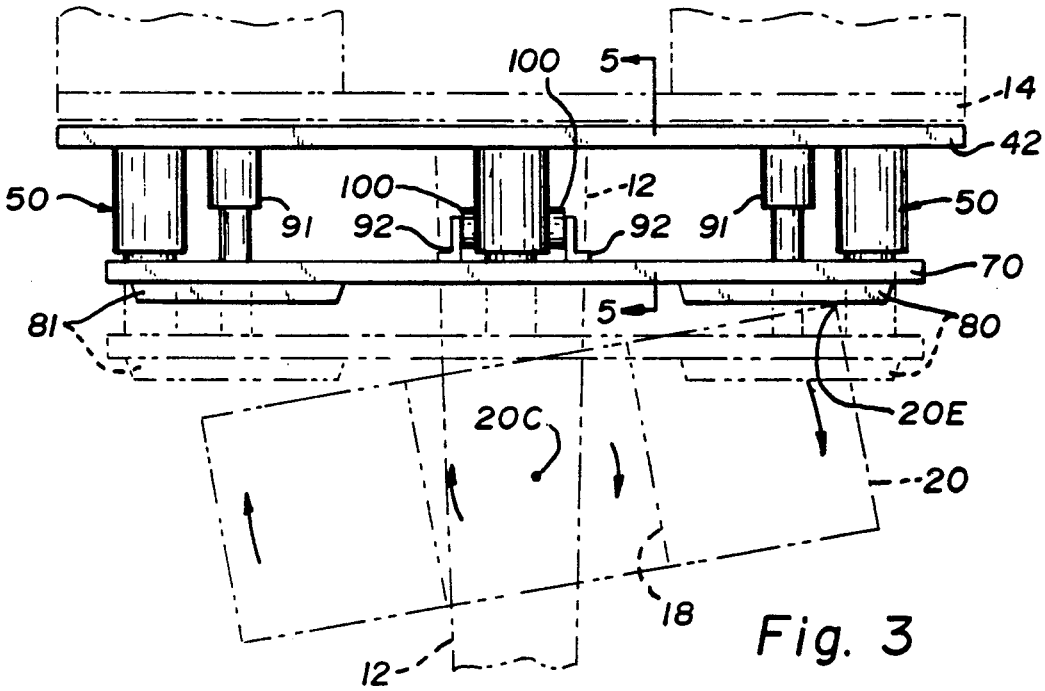
FIG. 3 is a top view of the apparatus of FIGS. 1 and 2 with a moved position of associated parts and a steel roll shown in phantom outline.
Figure 4:
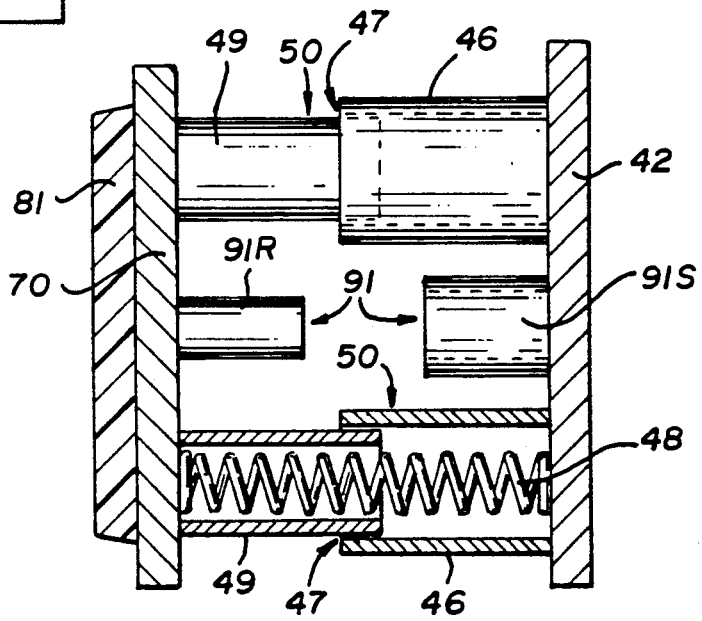
FIG. 4 is a side view with parts cut away and shown in phantom outline and outer parts shown in dashed outline of the apparatus of FIGS. 1–4.

In accordance with the present invention, a unique load cushioning apparatus 40 is provided mounted to the front wall 14 of a lift unit 16. As may be entirely conventional, the lift unit 16 including the ram 12 and wall 14 is raisable on a frame 18 by the truck operator. Being conventional and well-known, except for the novel apparatus 40 of the present invention, it is not necessary to detail the lift truck structure and operation. The merchandise protector apparatus 40 includes a rear wall 42 which is bolted by bolts 44 (or otherwise attached) to the wall 14. The rear wall 42 as shown in FIGS. 3 and 4 has six large diameter tubular projections 46 which form part of a telescoping housing 47 for springs 48 (FIG. 4) which together constitute energy absorbing and alignment units 50.

Figure 2:
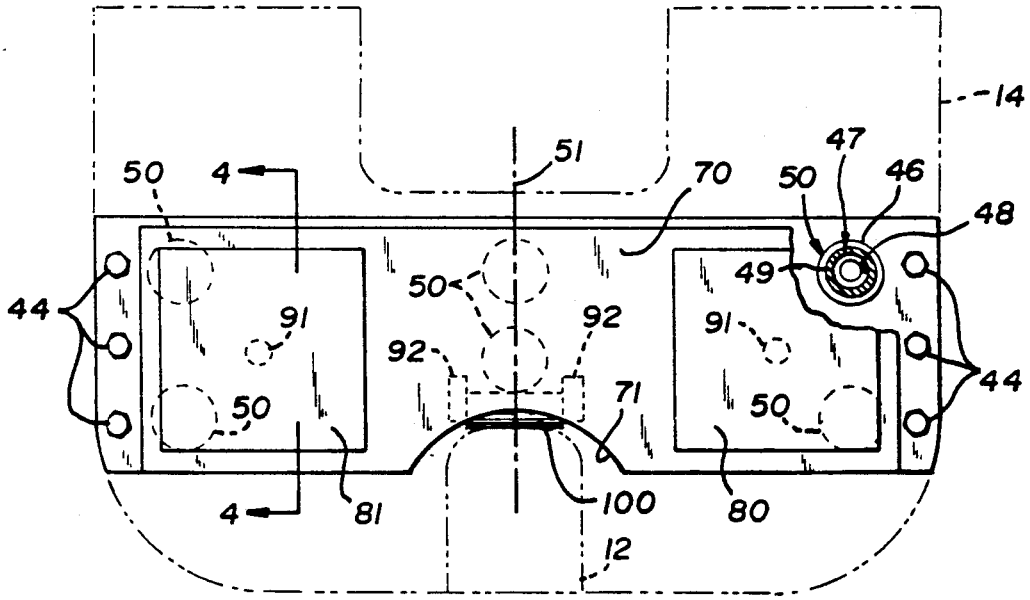
FIG. 2 is a front elevational view of the apparatus of FIG. 1 with the front wall of a lift truck and ram shown in phantom outline.
Figure 5:
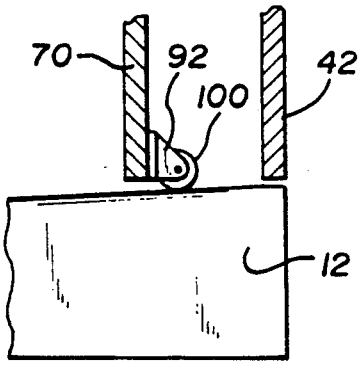
FIG. 5 is a side sectional fragmentary view as seen from the line 5—5 in FIG. 3.

The six units 50 are all identical in construction and positioned as indicated in FIG. 2 at approximately each corner of the back wall 42 and at its vertical center line 51. The forward ends of the units 50 are affixed to the rearward side of a generally rectilinear vertical front wall 70 shaped to accommodate the ram 12 by having a radius cut base cutout 71 providing clearance above the ram (with, for example, about one-half inch clearance therefrom). Otherwise, the wall 70 spans across and on either side of the ram 12. As best shown in FIG. 5, contact wall 70 includes a roller 100, preferably of steel about two inches in diameter, mounted by brackets 92 to its rear surface. The roller 100 contacts the top surface of the ram 12 and rolls horizontally therealong when the wall 70 moves horizontally. The roller 100 serves to transfer the vertical components of loads placed on the contact wall 70 to the ram 12.

A pair of pads 80, 81 are secured to the wall 70 at its left and right sides. The pads 80, 81 are identical in size and thickness and are made of a resilient but slippery material such as polyester or nylon. The pads 80, 81 are positioned so that they will make first contact with the edge (such as 20E in FIG. 3) of the coil 20 when the coil 20 is not precisely aligned with the ram and wall. The energy of contact is in part absorbed by the springs 48 of the unit 50 and by some compression of the pads 80, 81 and in part serves to rotate the coil 20 about its center (20C in FIG. 3) so as to seat it flush against both of the pads 80 and 81, often, in the process, slipping the edge 20E of the coil along the surface of the pad. Over time, the pads may become worn by this contact and for that reason are preferably made so as to be easily replaced when so worn.

A pair of alignment units 91 are also provided for making sure the wall 70 is properly aligned essentially parallel to the wall 42 at the end of its rearward travel. Each of these units 91 include a rod 91R affixed to the rear of the wall 70 and a socket 91S affixed to the front of the wall 42 and so dimensioned as to have the rod 91R enter into the socket 91S as the wall 70 reaches its rearmost position with the spring 48 compressed and the telescoping units 50 at their most compressed configuration.

The springs 48 are chosen so as to have a compression constant such that the energy of an initial "strike" of the ram-truck 10 with a coil of merchandise at its expected higher speed is absorbed by the assembly 40 and transferred in part over a short period of time into turning the coil 20 about its center of mass and area of contact and the floor. The springs 48 are preferably affixed at either longitudinal end, by welding or otherwise, to the wall 42 or 70 and thus serve to connect the wall 70 and its associated parts to the wall 42.

For purposes of definiteness and not for limiting the scope of the present invention, one concrete example of the apparatus 40 will be hereafter set out. Of course, the present inventor and others may well decide in the future for reasons of economy or as a result of expense to change from the following dimensions and materials, and it is an intent of the claims to cover all embodiments of the invention. However, at the present time, a preferred construction of the apparatus 40 would comprise a back wall 42 of a steel plate, approximately one-half inch thick, shaped as shown in the drawings and having a width of about the length of the base of the vehicle and a height of about 16 inches. The forward plate 70 would preferably then be made of steel plate, about one-half inch thick, also shaped as shown and having an overall width of approximately two inches less than the base of the vehicle and a height of about 16 inches. The pads 80, 81 would each be of polyester or nylon approximately one to two inches thick and of about 14 inches by 14 inches in size. The units 50 would be made according to the capacity of the vehicle and weight of the coils to be handled, from about two inches diameter and two and one-half inch diameter pipe, with the pipe 46 being about four inches long and the pipe 49 approximately four inches long. The spring 48 would preferably have a size of approximately one and three-fourths inch in diameter, a length unloaded of about eight inches, a fully compressed length of about four and one-half inches and a spring constance of compression therebetween according to the capacity of the vehicle.

The alignment units 91 would preferably include rods 91R of an approximate diameter of two inches and a length of about four inches. The sockets 91S are preferably about three inches in diameter with an inside diameter of about two inches and a length of about four inches but may be modified to accommodate the capacity of the truck. The units 91 are centered at about eight inches below the top of the wall 42 and about eight inches from its respective left and right edges. The units 50 at the corners of the back wall 42 are located about four inches from its side edges and four inches from either its top or bottom edges. Also, the units 50 and units 46 should be placed in the middle of the protector apparatus 40. The roller 100 is preferably about two inches in diameter and made of solid steel with an approximately three-quarter pin projection into suitable journals formed in the brackets 92.

It should now be apparent that a merchandise protector apparatus has been described for coil lift trucks which will materially lessen or avoid the denting of coils during handling by a truck equipped with the protector apparatus. The protector apparatus may be incorporated as original equipment or in many cases added on to existing lift trucks. The apparatus 40 may be adapted to be retrofitted into different trucks primarily by shaping the rear wall to conform to the forward wall of the truck lift apparatus. In some cases, this may involve forming the rear wall in two separate sections, one on either side of the ram.

While one particular embodiment of the invention has been shown and described, it will be obvious to those skilled in the art that changes and modifications may be made without departing from the invention and, therefore, the aim in the appended claims is to cover all such changes and modifications as fall within the true spirit and scope of the invention. For example, it may be desirable to provide side and top wall sections projecting from the rear wall so as to provide a shield against broken strings or other parts being projected out from between the contact wall and rear wall.

I claim:

1. In a lift truck for lifting coils of the type having a central axial core opening, an annular end face perpendicular to the central axial core opening and an outer edge at the periphery of the annular end face, the lift truck being of the type having a generally horizontal projecting ram for engaging the central axial core opening of a coil and means for mounting and moving the ram vertically on the truck, the improvement comprising:

contact wall means mounted generally vertically at an approximate right angle to the ram and extending horizontally on both sides of the ram for a distance at least approximating the radius of the coil; and means for mounting said contact wall means to said truck, which mounting means include shock absorbing means for absorbing horizontal forces and for allowing the contact wall means to move horizontally relative to the ram in response to contact with a coil, said shock absorbing means being disposed on both sides of said ram and being spaced from said ram; and rear wall means affixed to the truck;

wherein said shock absorbing means includes a plurality of springs disposed generally horizontally between said contact wall means and said rear wall; and means for maintaining said contact wall means and said rear wall means in an approximately parallel relationship while said contact wall means moves horizontally.

2. The invention of claim 1, wherein said means for maintaining a parallel relationship includes telescoping housings surrounding each of said plurality of springs.

3. The invention of claim 2, wherein said contact wall means includes surface pads of elastic and slippery material disposed on both sides of said ram and spaced from said ram.

4. The invention of claim 1 wherein roller means are provided between said contact wall and said ram.

5. The invention of claim 4 wherein said ram has a top surface and wherein said roller means is a roller mounted to said contact wall, which roller contacts the top surface of the ram and rolls over the top surface of the ram as the contact wall moves horizontally.

6. Apparatus for retrofitting to a lift truck of the type having a generally horizontal projecting ram for engaging a coil of the type having a central core opening aligned with the central longitudinal axis of the coil for receiving the ram, an annular end face substantially perpendicular to the central axial core opening, the apparatus comprising:

contact wall means for being mounted generally vertically at an approximate right angle to the ram and extending horizontally on both sides of the ram, the contact wall means having a width at least approximating the width of the annular end face of the coil;

a rear wall affixable to the truck;

means for mounting said contact wall means to said truck, which mounting means include shock absorbing means for absorbing horizontal forces and for allowing the contact wall means to move horizontally relative to the ram in response to contact with a coil, said shock absorbing means being spaced from the center of the contact wall means so that the shock absorbing means are disposed on both sides of the ram when the retrofitting apparatus is installed on the lift truck;

wherein said shock absorbing means includes a plurality of springs disposed generally horizontally between said contact wall means and said rear wall; and means for maintaining said contact wall means and said rear wall in an approximately parallel relationship while said contact wall means moves horizontally.

7. The invention of claim 6, wherein said contact wall means includes surface pads of elastic and slippery material spaced from the center of said contact wall means.

8. The invention of claim 7 wherein said plurality of springs includes a spring substantially aligned with a portion of each surface pad.

9. The invention of claim 6, wherein said means for maintaining a parallel relationship includes telescoping housings surrounding each of said plurality of springs.

10. The invention of claim 9, wherein said contact wall means includes surface pads of elastic and slippery material spaced from the center of said contact wall means.

11. The invention of claim 6 wherein roller means are provided between said contact wall and said ram.

12. The invention of claim 11 wherein said ram has a top surface and wherein said roller means is a roller mounted to said contact wall, which roller contacts the top surface of the ram and rolls over the top surface of the ram as the contact wall moves horizontally.

13. Apparatus for retrofitting to a lift truck of the type having a generally horizontal projecting ram for engaging a coil of the type having a central core opening for receiving the ram, the central core opening being aligned with the central longitudinal axis of the coil, the coil having an annular end face perpendicular to the central longitudinal axis of the coil and an outer edge at the periphery of the end face, the retrofitting apparatus comprising:

contact wall means for being mounted generally vertically at an approximate right angle to the ram and sized for extending horizontally above and on both sides of the ram for a distance at least approximating the radius of the coil so that the outer edge of the coil will contact areas of the contact wall means when the coil is entered by the ram when the ram is other than parallel with the vertical plane through the central longitudinal axis of the coil;

means for mounting said contact wall means to said truck, which mounting means include shock absorbing means for absorbing horizontal forces and for allowing the contact wall means to move horizontally relative to the ram in response to contact with a coil;

said means for mounting said contact wall means including rear wall means affixable to the truck about the ram thereof;

said shock absorbing means includes a plurality of springs disposed generally horizontally between said contact wall means and said rear wall;

said means for mounting said contact wall means further including means for maintaining said contact wall means and said rear wall in an approximately parallel relationship while said contact wall means moves horizontally, including telescoping housings surrounding each of said plurality of springs, wherein said contact wall means includes a surface pad of elastic and slippery material at the areas wherein the edges of a coil may strike the contact wall means when the ram enters a coil; and said means for mounting said contact wall means further including roller means including a roller mounted to said contact wall, which roller is mounted for contacting the ram and rolling over the ram when the mounted contact wall moves horizontally.

* * * * *